US005108273A

United States Patent [19]

Romanyszyn, Jr.

[11] Patent Number: 5,108,273

[45] Date of Patent: Apr. 28, 1992

[54] HELICAL METERING PUMP HAVING DIFFERENT SIZED ROTORS

[75] Inventor: Michael T. Romanyszyn, Jr., Springfield, Ohio

[73] Assignee: Robbins & Myers, Inc., Dayton, Ohio

[21] Appl. No.: 575,094

[22] Filed: Aug. 30, 1990

[51] Int. Cl.[5] ..... F04C 5/00; F04C 11/00; G05D 11/02

[52] U.S. Cl. ..... 418/15; 418/48; 418/153; 137/99

[58] Field of Search ..... 418/15, 48, 153, 209, 418/210, 215; 137/99, 896; 366/51, 190

[56] References Cited

U.S. PATENT DOCUMENTS

| | | | |
|---|---|---|---|
| 2,329,386 | 9/1943 | Brennan | 418/48 |
| 2,691,346 | 9/1948 | Conery | 417/79 |
| 2,733,854 | 2/1956 | Chang | 418/48 |
| 3,203,350 | 8/1965 | Chang | 418/48 |

FOREIGN PATENT DOCUMENTS

| | | | |
|---|---|---|---|
| 2040748 | 2/1972 | Fed. Rep. of Germany | 418/48 |
| 2418967 | 10/1975 | Fed. Rep. of Germany | 418/48 |
| 449174 | 9/1975 | U.S.S.R. | 418/48 |

*Primary Examiner*—John J. Vrablik
*Attorney, Agent, or Firm*—Biebel & French

[57] ABSTRACT

A pump assembly includes commonly driven coaxially positioned helical rotors, rotatably engageable within corresponding stators. Each combination of rotor and stator defines a pump having a different volumetric flow rate, each pump discharging to a common discharge port, thereby providing an accurately proportioned mixed fluid of two separate fluids. The rotors are integrally molded from a thermoplastic material and include an integral drive shaft suitable for interconnection to an electric motor. The two rotors are simultaneously driven by a common drive shaft and therefore produce a constant mixed ratio irrespective of rotational speed.

8 Claims, 6 Drawing Sheets

HELICAL METERING PUMP HAVING DIFFERENT SIZED ROTORS

BACKGROUND OF THE INVENTION

The subject invention relates to a pump assembly having a controlled mixing ratio for metering plural fluids.

Pump assemblies are presently available for metering, and subsequently mixing, prescribed volumes of fluids. These assemblies generally comprise independently driven pumps, where each pump supplies a separate fluid to a common discharge line where the two fluids are mixed. The two fluids are mixed in proportion to the volumetric flow rates of the pumps to provide the required mixture ratio flow rate of the mixed fluid. For example, if the required flow rate of the mixed fluid is 6 gallons per minute (GPM), and the prescribed mixing ratio is 5 to 1, two pumps are chosen which provide 5 GPM and 1 GPM, respectively.

In practice, the design of such an assembly is not so simplistic as the above example, as most applications also require the pump assembly to provide a variable range of available mixed fluid flow rates, while still maintaining a constant mixing ratio. In order to vary the flow rate of the mixed fluid, the speed of the individual pumps must be variable, to provide a range of output flow rates for the individual fluids.

Therefore, the two pumps are typically driven independently by electric motors, where one of the motors has a device for sensing the rotational speed of the motor drive and providing a feedback signal to the other drive motor, to vary the speed of the other pumps accordingly. The flow rate of the mixed fluid is controlled by varying the pump with the sensor, and the other is varied, vis-a-vis the feedback, to maintain the given mixing ratio.

One of the disadvantages to the above-mentioned device is that there is a response time involved in varying the second motor speed, and during such time, the mixing ratio is fluctuating. Furthermore, the device is not useable in applications where the required flow rate of the mixed fluid is constantly varying, as the response time involved is too high to ever produce a steady state fixed mixing ratio.

This pump assembly is also cost prohibitive for many applications, due to the design complexity. As mentioned above, the assembly includes two separate pumps and motors, feedback equipment for sensing the speed of the main motor, and means to receive the feedback signal to calibrate and adjust the speed of the follower motor in order to maintain a constant flow rate.

An object of the invention then is to provide an apparatus for maintaining a fixed mixing ratio of two fluids irrespective of the required mixed fluid delivery flow rate.

A further object of the invention is to provide a metering apparatus which is not cost restrictive and is available for numerous applications.

Other objects and advantages of the invention will be apparent from the following description, the accompanying drawings and the appended claims.

SUMMARY OF THE INVENTION

The objects of the invention were accomplished by providing a metering apparatus comprising an outer casing having a first inlet port for a first fluid, a second inlet port for a second fluid, and a discharge port for a mixture of first and second fluids. Inner and outer helical stator elements are in coaxial disposition in the outer casing, and inner and outer helical rotor elements are in rotational engagement within respective inner and outer stator elements. The inner and outer stator elements have one more thread than respective inner and outer rotor elements, and the outer stator element has an input end in communication with the first inlet port and an output port in communication with the discharge port on the casting. The inner stator has an input end in communication with the second inlet port and an output port in communication with the discharge port in the casing, and interconnection means for simultaneously driving the inner and outer rotor elements from a common input source to mix first and second fluids in proportion to the displacement of the first and second stators, and discharge the mixed fluid through the discharge port of the casing.

By providing interconnection means for simultaneously driving the inner and outer rotor elements, the rotational speed of the inner and outer rotors is always equal, thereby providing a constant mixing ratio irrespective of rotational speed.

DETAILED DESCRIPTION OF THE PREFERRED EMBODIMENT

Figure 1:
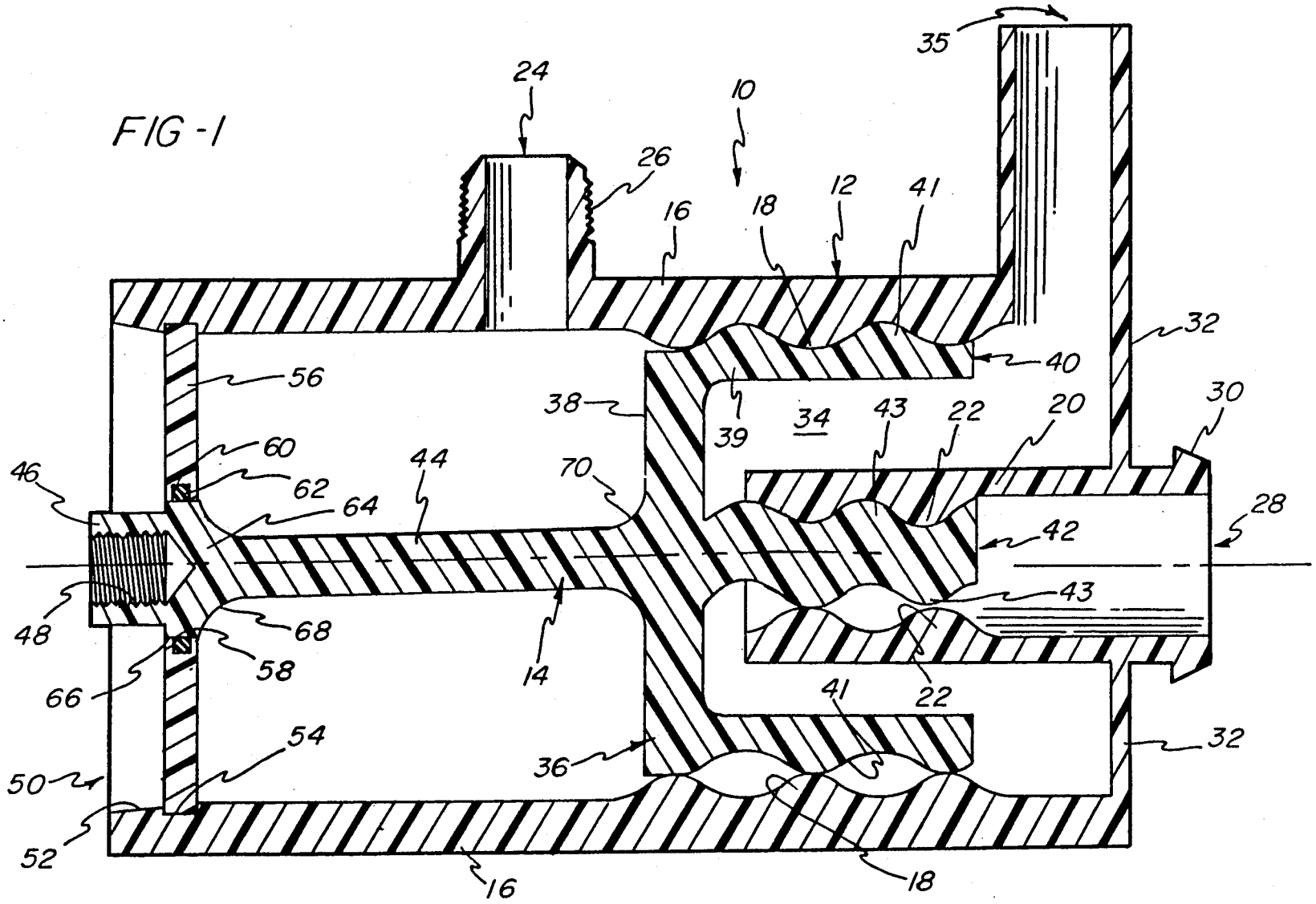
FIG. 1 is a cross-sectional view through the longitudinal centerline of the subject invention.

With reference to FIG. 1, a metering pump is shown generally at 10, comprising a casing 12 and a rotor shaft 14. The casing 12 comprises an outer casing portion 16 having helical elements or threads 18, thereby defining an outer stator, and an inner casing portion 20 having helical elements or threads 22, thereby defining an inner stator. The casing 12 further comprises an inlet port 24 for receiving a first fluid where, in the preferred embodiment of the invention, the inlet port includes a threaded connection at 26, for the connection and disconnection of a hose fitting. The casing further comprises a second inlet port at 28 for receiving a second fluid, where the inlet port 28 is continuous with the inner casing section 20, and includes a nipple 30 for latching to a quick disconnect-type connection. The inlet port 28 is integral with a side plate 32 thereby enclosing a chamber 34 formed between the helical threads 18 and the inner casing portion 20. The casing 12 also includes a discharge port at 35 communicating with both inlet ports 24 and 28, for discharging the mixed fluid comprised of the fluids through inlet ports 24 and 28.

The rotor assembly 14 includes an outer drum-shaped rotor portion 36 comprising a rear circular plate 38, and a cylindrical ring portion 39, thereby defining an outer rotor 40 having helical elements or threads 41 on an outer periphery thereof. The rotor assembly 14 also includes an inner rotor portion 42 having helical elements or threads 43. The rotor assembly 14 further comprises a drive shaft 44 having an end connection section 46 preferably including internal threads at 48 for connection to the threaded shaft of an electric motor (not shown).

The outer casing section 16 includes at the end opposite the end plate 32, an opening 50 formed by an annular beveled edge 52, with a locking groove 54 beyond the edge 52. To seal the internal structure, the pump 10 includes a sealing plate 56 snap latched into the groove 54. The plate 56 includes a central opening at 58, where the opening includes an internal groove at 60 carrying an O-ring 62. The rotor assembly includes a bearing portion 64 having a peripheral surface 66 in rotatable sealing contact with the O-ring 62.

Figure 2:
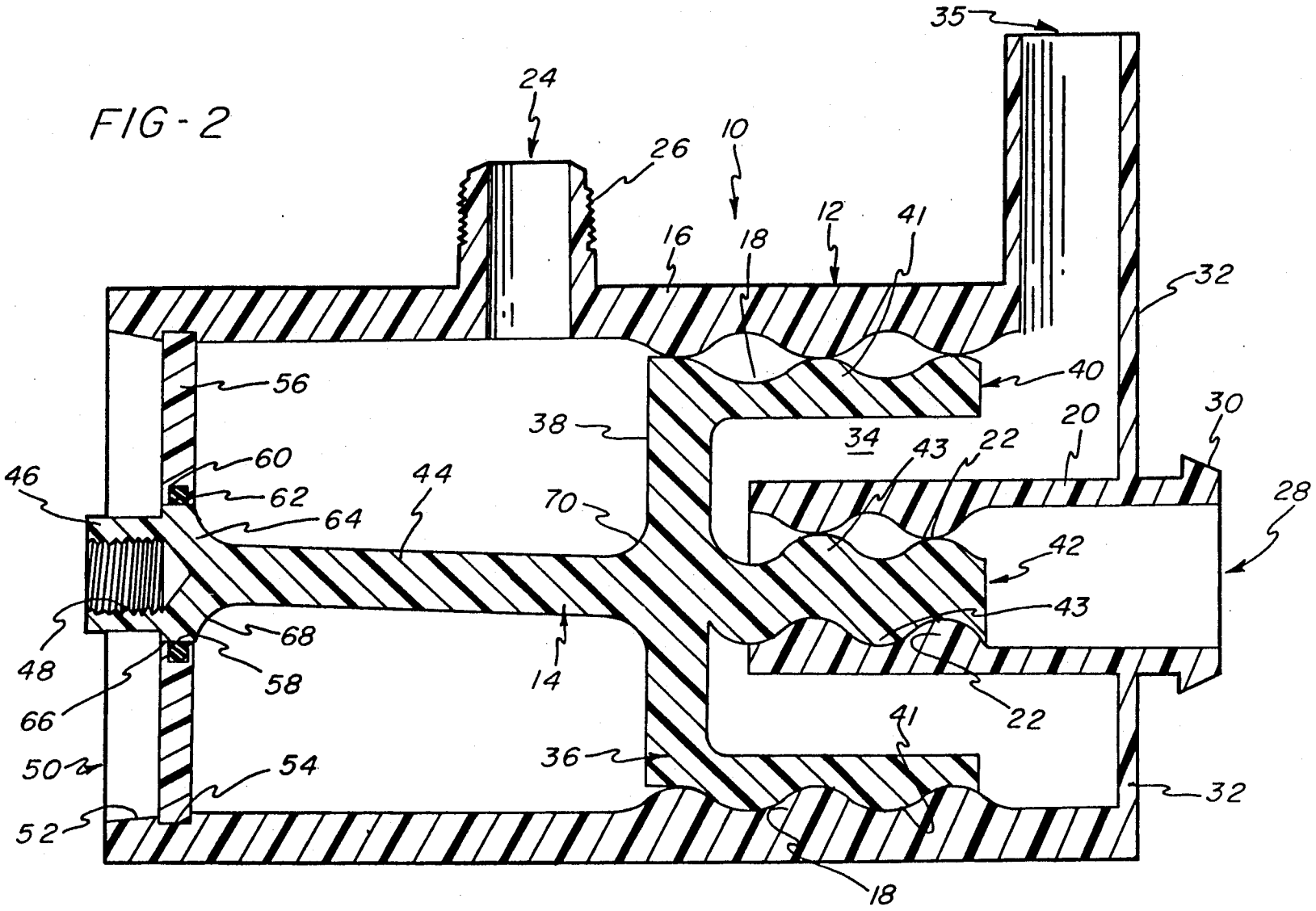
FIG. 2 is a cross-sectional view similar to that of FIG. 1, showing the rotors rotated 180°.

The inner and outer rotor portions 42, 40 and the inner and outer stator elements 22, 18 are operable under the principles shown in the Moineau U.S. Pat. Nos. 1,892,217 and 2,085,115, the subject of which is incorporated herein by reference. According to these principles, a rotor engageably rotates within a stator, where the stator and rotor have helical threads, the pitch of the rotor is twice that of the stator, and where the stator has one more thread than the rotor. In practice, the stator typically includes two threads whereas the rotor includes one thread. The rotation of the rotor within the stator therefore produces a helical progressive void thereby pumping fluid from one end of the stator to the other. This progression can be appreciated by a comparison of FIGS. 1 and 2, where FIG. 2 is a view showing the rotor assembly 14 rotated 180°, relative to the position in FIG. 1.

In the preferred embodiment of the invention, the inner and outer rotor portions 42, 40, respectively, have a single thread at a pitch of 0.60 threads per inch, whereas the inner and outer stator elements 22, 18, respectively, have two threads, with each thread having a pitch of 1.20 threads per inch. It should also be understood that the thread pairs 18, 41; and 22, 43, are reverse from each other, such that upon rotation of the shaft 44, the fluid through port 24 is moved from left to right, as viewed in FIG. 1, and the fluid through port 28 is moved from the right to the left, as viewed in FIG. 1. The two fluids are thereby mixed together and commonly discharged through port 35.

It should also be appreciated that the aforementioned rotor assembly 14 rotates in an eccentric path, causing the center of the rotor shaft to orbitally rotate in a circular path. In the preferred embodiment of the invention, both the rotor assembly 14 and the outer casing assembly are molded from a thermoplastic material, and this eccentric motion is taken up by the flexible plastic shaft 44. The shaft is therefore molded with enlarged radii of curvature at 68 and 70 preventing any stress concentration at these intersections. Thus, in the preferred embodiment of the invention, the inner and outer rotors 42, 40 have the same eccentricity and pitch, and therefore the eccentric motion of the two rotors is coincident, and this eccentric motion is compensated by the flexible shaft 44. Thus the drive end 46 can freely rotate along a constant centerline without the need for a universal joint on the drive motor. The drive shaft of the electric motor (not shown) will need some means to bear the thrust of the shaft 44, and preferably, the thrust bearing will be bi-directional, as the net thrust is dependent upon the application of the pump, particularly the pressure of the fluid through the input ports 24 and 28.

In such a pump design, the pump displacement is calculated by the following formula:

$$\text{Displacement} = D \times 4e \times Ps \times RPM$$

where:

D × cross-sectional diameter of the rotor;
e × eccentricity of the rotor;
Ps × pitch of the stator; and
RPM × angular velocity of the rotor in revolutions per minute.

In the preferred embodiment of the invention then, the displacement for the two separate pumps is a function of the rotor diameter only, as the eccentricity, the stator pitch and the angular velocity of both rotors is equal. Thus, a 5 to 1 mixing ratio can be accomplished by simply providing the outer rotor 40 with a diameter five times that of the inner rotor 42. Theoretically then, the mixing ratio is infinite as the diameter of the outer rotor can be increased infinitely. Practically however, the maximum mixing ratio is on the order of 5 to 1, as the diameter of the outer rotor becomes too large for many applications.

In the event a larger mixing ratio pump assembly is required, the pitch can be changed between the inner and outer rotor, to change the volumetric output on one of the pumps thereby changing the mixed fluid ratio. If the pitch is changed between the inner and outer rotors, the eccentricity of the two rotors remains coincidental, and the two rotors may still be fixedly connected together.

Figure 3:
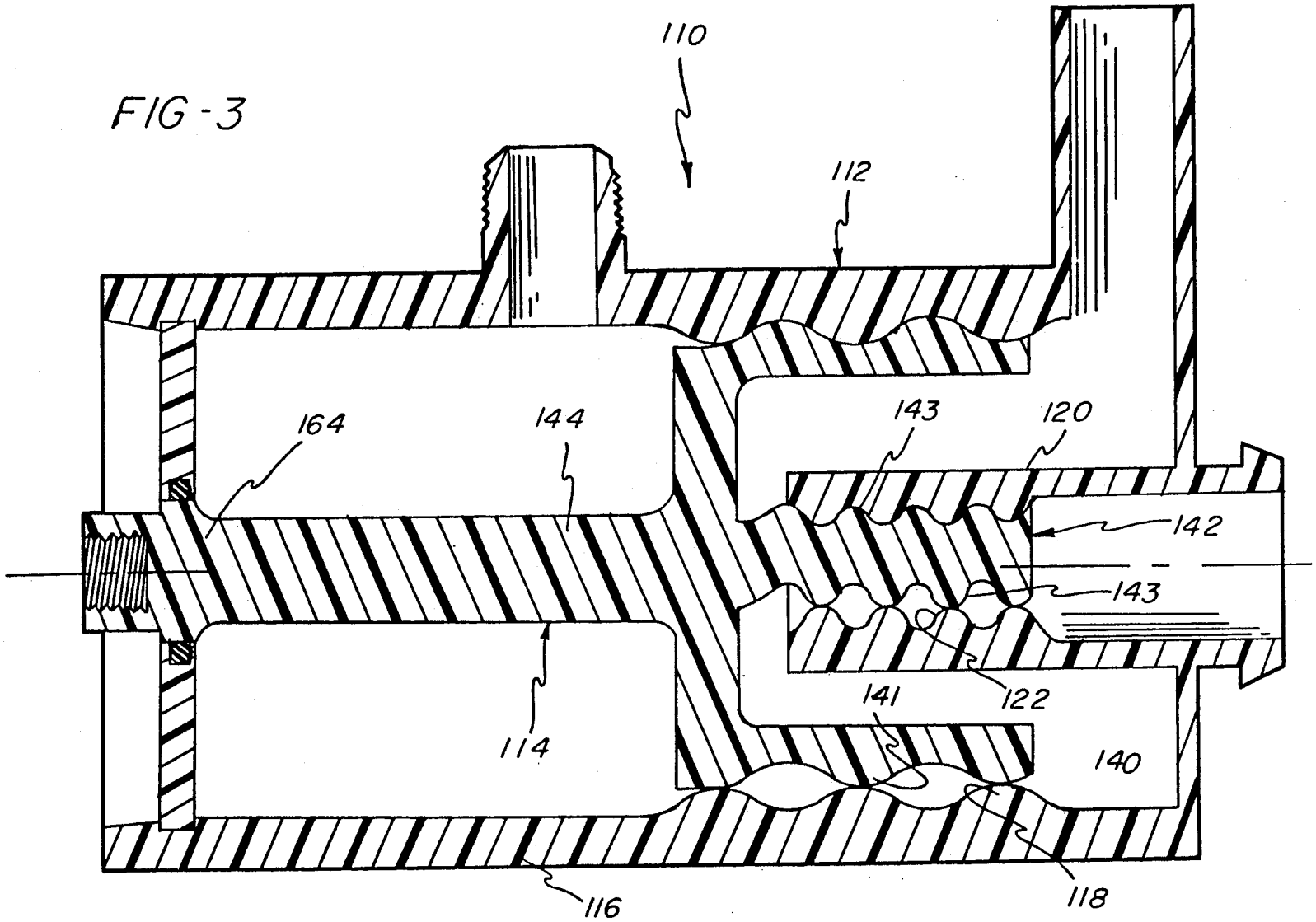
FIG. 3 shows a first alternate embodiment of the invention where the inner and outer rotors have the same eccentricity but different pitches.

With reference to FIG. 3, an embodiment of pump is shown at 110 comprising an outer cassing 112 and a rotor assembly 114 having an outer rotor element 140 having helical threads 141, and an inner rotor 142 having helical threads 143. The helical threads 141 are rotatably engageable with the helical threads 118, while the helical threads 143 are rotatably engageable with the helical threads 122. It should be noted that the pitch of the threads 143, 122 is one-half that of the threads 141, 118. The outer rotor element 140 and the inner rotor element 142 are integrally connected to a common drive shaft 144.

With the pitch of the inner rotor one half that of the outer rotor, the mixing ratio can now be held at 10 to 1, without further increasing the diameter of the outer rotor, that is the diameter of the rotors in the FIG. 3 embodiment are the same as the FIG. 1 embodiment. The mixing ratio could be again increased by increasing the pitch of the outer rotor. It should also be understood that the pump can be sized for any increment of mixing ratio between 10 to 1 by simply varying the rotor or stator diameters or pitches appropriately.

In the event the mixing ratio requires further modification, the eccentricity can be changed between the inner and outer rotor, to change the volumetric output on one of the pumps thereby changing the mixed fluid ratio. However, if the eccentricity is changed between the inner and outer rotors, the two rotors must be capable of independent eccentric movement.

Figure 4:
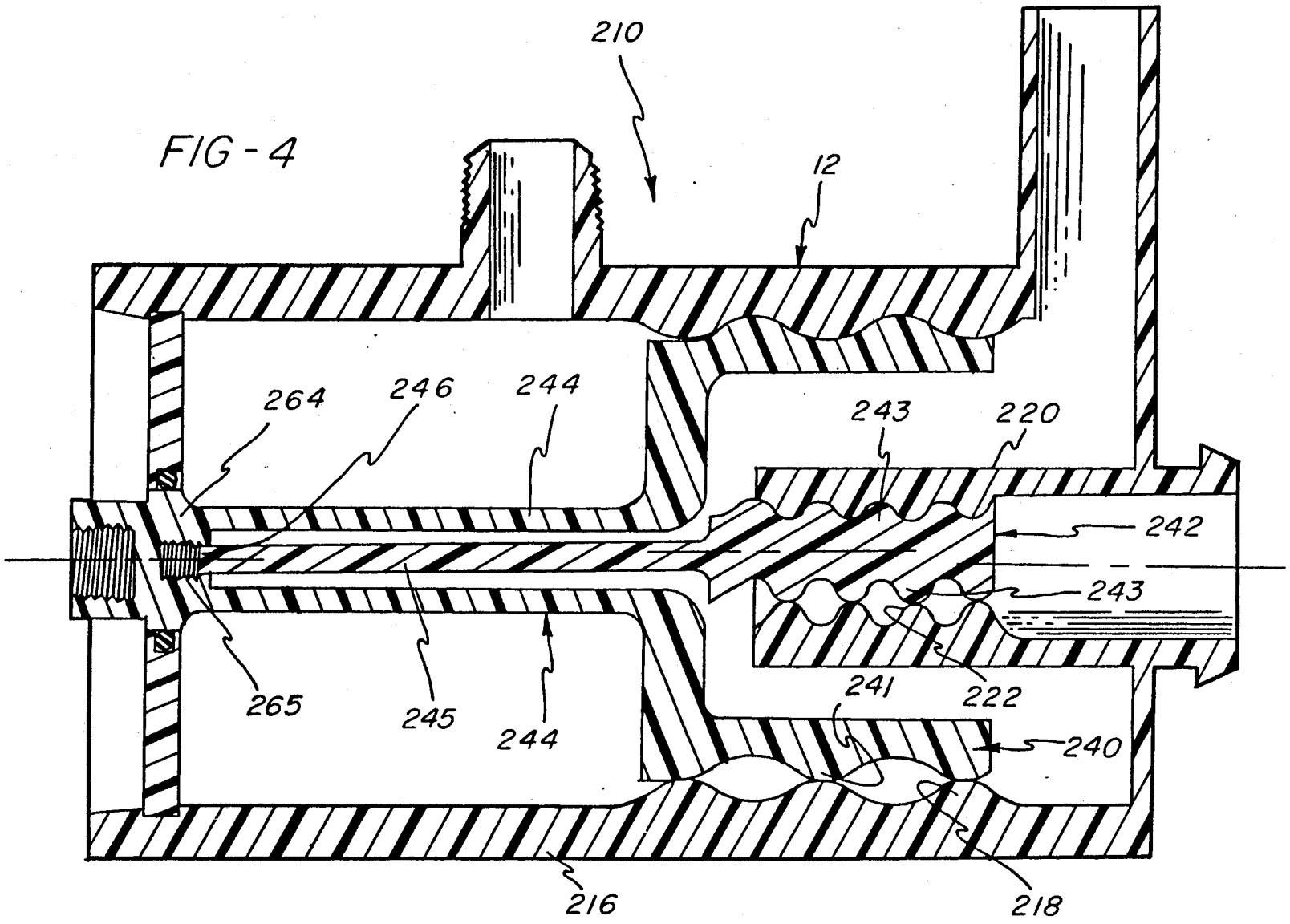
FIG. 4 shows a second alternate embodiment of the invention where the pitch and the eccentricity of the inner and outer rotors are different.

With reference to FIG. 4, an embodiment of pump is shown at 210 comprising an outer casing 212 and a rotor assembly 214 having an outer rotor element 240 having helical threads 241, and an inner rotor 242 having helical threads 243. The helical threads 241 are rotatably engageable with the helical threads 218, while the helical threads 243 are rotatably engageable with the helical threads 222. As the eccentricity of the rotors 240 and 242 is different, the shafts 244, 245 must be capable of independent movement.

As shown in FIG. 4, the rotor 240 includes an independent outer quill 244 having an internal bore threaded at 265, while the inner rotor 242 includes a spindle shaft 245 threaded at 246 and threadably inserted into the bore of the quill 244. As shown in FIG. 4, the inner spindle shaft 245 is movable within the shaft 244 to the extent of the clearance between the two shafts, and is movable independently of the outer quill 244.

Figure 6:
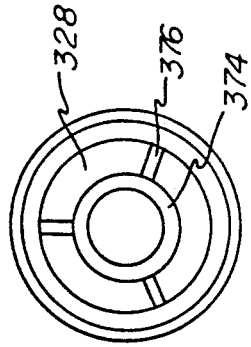
FIG. 6 is an end view as viewed from lines 6—6 of FIG. 5.
Figure 5:
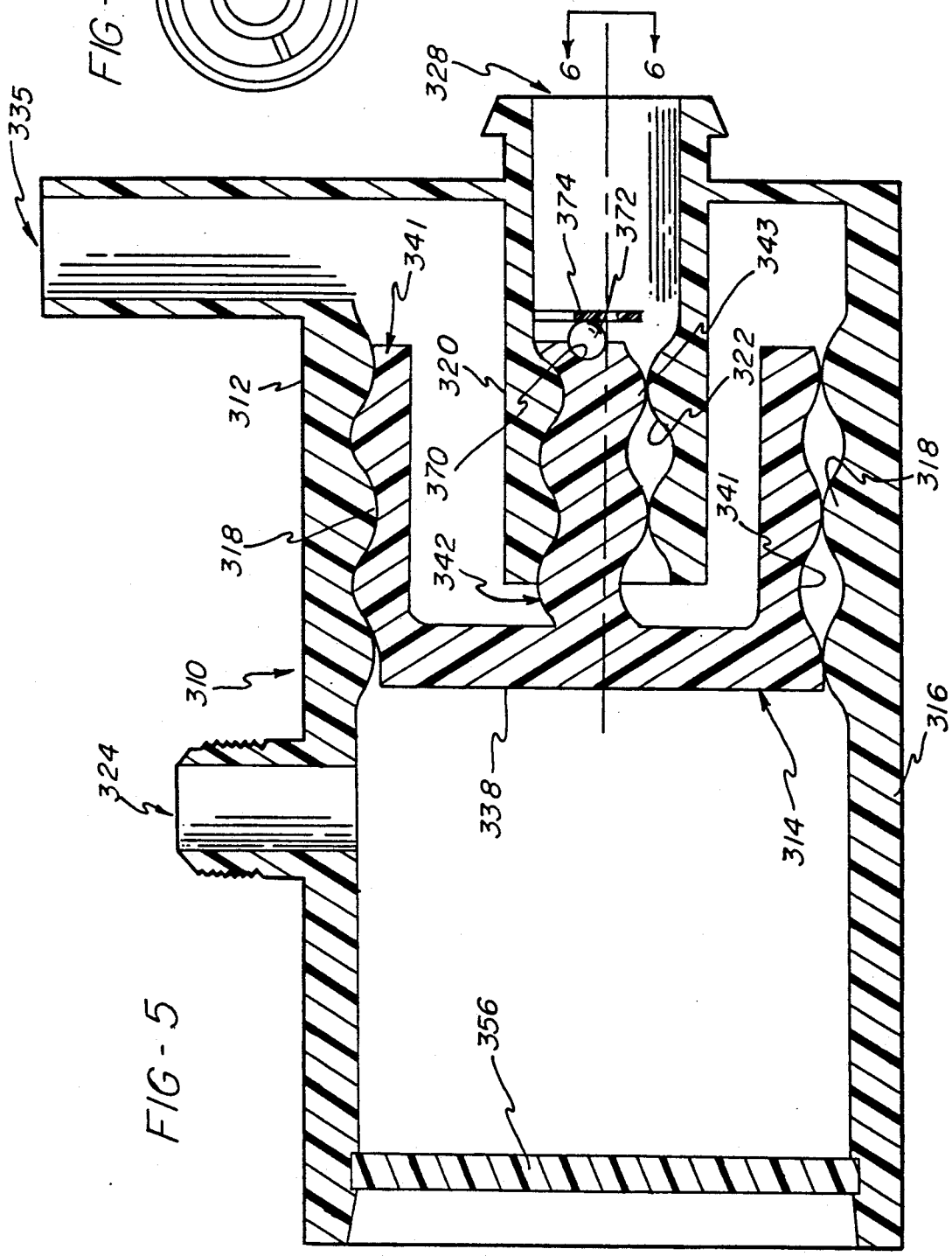
FIG. 5 shows a third alternate embodiment of the invention.

As shown in FIGS. 5 and 6, the double rotor design can also be used with a high pressure fluid as a metering valve. As shown in FIG. 5, the pump is shown at 310 having an outer casing 312 and a rotor assembly 314. The rotor assembly 314 comprises an outer rotor 340 and an inner rotor 342, where the rotor assembly independently rotates within the casing 312 without a drive shaft, under the influence of a high pressure fluid inserted through the inlet port 324 acting on the helical threads 341, thereby rotating the outer rotor 340 and the integral inner rotor 342. This rotation provides the metering of fluids through the inlet ports 324 and 328 as mentioned in the previous embodiments and discharges the mixed fluid through the discharge port 335. The metering valve is stopped by simple removing the pressure from the inlet port 324, for example by a gate valve above the port 324.

As shown in FIG. 5, the high pressure fluid through the inlet port 324 also acts on the back side of the plate 338, creating a net force ot the right, as viewed in FIG. 5, and therefore some means of thrust bearing must be provided. As shown in FIGS. 5 and 6, the end of the inner rotor includes a recessed aperture 370 carrying a spherical roller ball 372 which is movable within the aperture 370, similar in nature to a ball of a ball point pen. The roller ball 372 will follow a circular path due to the eccentricity of the rotor shaft and therefore a washer 374 is provided within the stator 320 integrally molded therein via radially extending arms 376 which interconnect with the inner bore of the stator. Thus, during the application of the high pressure fluid through the inlet port 324, the rotor 342 spins within the respective stator 320, and the ball rides around the washer 374 in a circular path, thereby acting as a thrust bearing. Advantageously, the washer does not unduly constrict the opening 328 from the incoming fluid.

In this application then, if a high pressure fluid is to be mixed with another fluid, the rotor assembly 314 can be driven by the high pressure fluid, and metered with the second fluid to provide a mixed fluid.

Figure 7:
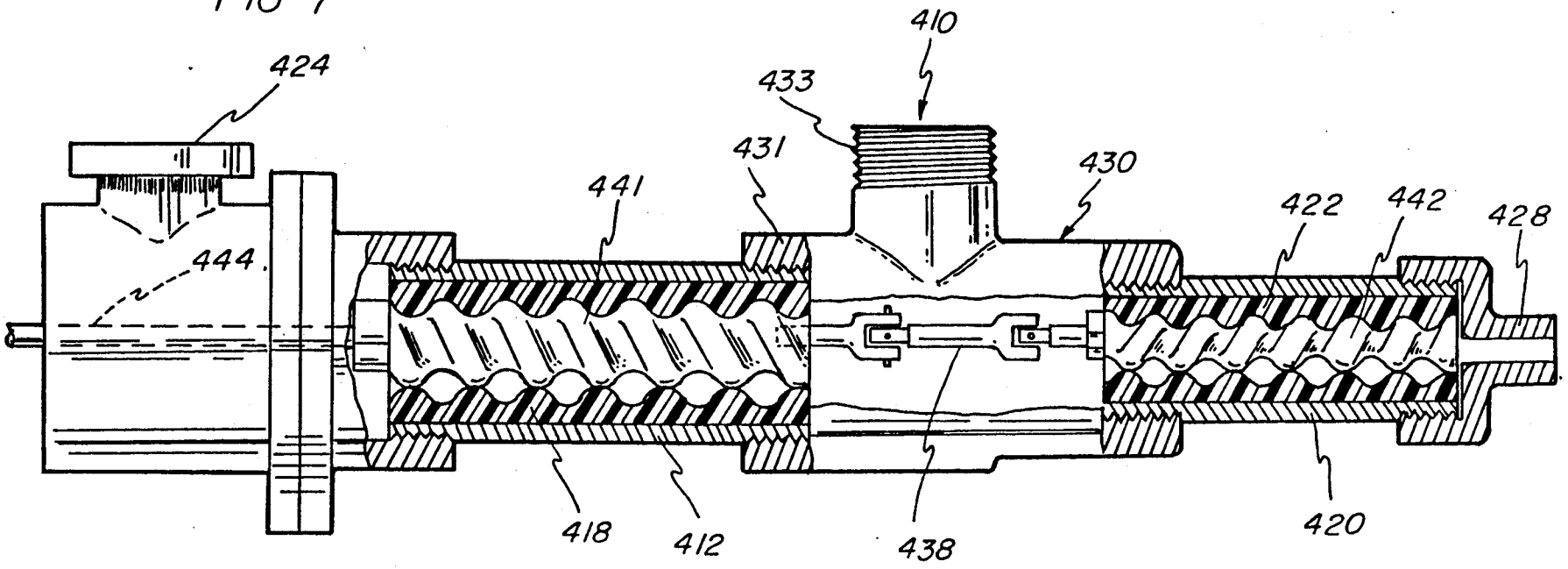
FIG. 7 is a cross-sectional view of a fourth embodiment of the invention where the two rotors are in-line and connected end-to-end.

Finally, with reference to FIG. 7, a fourth embodiment is shown where two helical pumps are interconnected in an in-line configuration. A first pump consists of a stator element 418 and a rotor 441, whereas a second pump consists of a stator element 422 and a rotor 442. The two rotors 441 and 442 are joined end-to-end along a common centerline. The stator 418 includes an outer frame 412 threadably interconnected to a T-coupling 430 at one side 431 thereof, and the stator 422 includes an outer frame 420 threadably secured to the opposite side 432. On of the fluids to be mixed is drawn in through the suction port 424, while the second fluid is drawn in through the second suction port 428. The rotors 441 and 442 operate in opposite directions to pump the two fluids into the T-coupling 430 where they are mixed, and are discharged through the third port 433 of the T-coupling 430.

It should be understood that the two fluids are still mixed in proportion to their diameters as described above. Preferably, the rotor 441 is larger in diameter than the rotor 442, such that the mixed fluid consists primarily of the fluid through suction port 424. If the rotors are in phase and have the same eccentricity, a solid shaft (not shown) could interconnect the two rotors 441 and 442. However, if the two rotors have different eccentricities or are out of phase, a flexible shaft, for example, a double universal joint, shown generally at 438, could be used. A drive shaft such as 444 is interconnectable to a motor for the simultaneous drive of the two rotors 441 and 442.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A pumping apparatus for metering plural fluids, comprising:

a housing means comprising first and second inlet ports and a discharge port, and an inner chamber;

a first pump having an outer rotor comprising a peripheral ring having at least one helical thread on an outer annular surface thereof, and a first stator having one more thread than said first rotor, said outer rotor being adapted for rotational engagement within said outer stator, and for pumping a first fluid, from said first inlet port to said discharge port, upon rotation of said outer rotor within said outer stator;

a second pump coaxially disposed within said first pump and having an inner rotor at least partially within said peripheral ring comprising at least one helical thread, and an inner stator having at least two threads, said inner rotor being coupled to said outer rotor and adapted for rotational engagement within said inner stator and for pumping a second fluid from said second inlet into mixing relation with the first fluid upon rotation of said outer rotor, whereupon the mixed fluid is discharged through said discharge port.

2. The apparatus of claim 1, wherein said inner and outer stators are integral.

3. The apparatus of claim 2, wherein said inner and outer rotors are integrally connected to a drive shaft.

4. The apparatus of claim 1, wherein said inner and outer rotors, and said respective inner and outer stators, have helical threads in oppositely operating directions.

5. The apparatus of claim 1, wherein said outer rotor is profiled such that application of a high pressure fluid through said first inlet port onto said outer rotor, rotates said outer rotor, and concurrently rotates said inner rotor, thereby metering first and second fluids in a fixed mixing ratio until the termination of the high pressure fluid.

6. The metering apparatus of claim 1, wherein said helical threads on said inner and outer rotor have a different pitch.

7. The metering apparatus of claim 6, wherein said inner and outer rotor include coaxially positioned, commonly connected, flexible drive shafts, thereby allowing the inner and outer rotor to follow different eccentric paths within their corresponding stator elements.

8. The apparatus of claim 1, wherein said outer rotor is profiled such that application of a high pressure fluid through said first inlet port onto said outer rotor, concurrently rotates said inner and outer rotors, thereby metering first and second fluids into a proportional mixing until the termination of the high pressure fluid.

* * * * *